US005718465A

United States Patent [19]

Dowling et al.

[11] Patent Number: 5,718,465

[45] Date of Patent: Feb. 17, 1998

[54] CHILD-PROOF FOR VEHICLE SLIDING DOOR LATCH DEVICE

[75] Inventors: Patrick Dowling; Hirofumi Watanabe, both of Yamanashi-ken, Japan

[73] Assignee: Mitsui Kinzoku Kogyo Kabushiki Kaisha, Tokyo, Japan

[21] Appl. No.: 661,911

[22] Filed: Jun. 12, 1996

[30] Foreign Application Priority Data

Jun. 13, 1995 [JP] Japan ..... 7-170419

[51] Int. Cl.[6] ..... E05C 3/06

[52] U.S. Cl. ..... 292/216; 292/336.3; 292/DIG. 23; 292/DIG. 65

[58] Field of Search ..... 292/216, 336.3, 292/DIG. 23, DIG. 46, DIG. 65

[56] References Cited

U.S. PATENT DOCUMENTS

| | | | |
|---|---|---|---|
| 4,487,441 | 12/1984 | Miyamoto et al. | 292/DIG. 65 X |
| 4,492,395 | 1/1985 | Yamada | 292/DIG. 65 X |
| 4,575,138 | 3/1986 | Nakamura et al. | 292/216 |
| 4,850,625 | 7/1989 | Hori et al. | 292/336.3 |
| 4,896,906 | 1/1990 | Weinerman et al. | 292/48 |
| 4,969,673 | 11/1990 | Portelli et al. | 292/216 |
| 5,052,731 | 10/1991 | Hayakawa et al. | 292/336.3 |
| 5,125,701 | 6/1992 | Hayakawa et al. | 292/DIG. 65 X |
| 5,309,745 | 5/1994 | Ursel et al. | 292/216 X |

FOREIGN PATENT DOCUMENTS 58-25155 5/1983 Japan .

*Primary Examiner*—Rodney M. Lindsey
*Attorney, Agent, or Firm*—Browdy and Neimark

[57] ABSTRACT

A latch device for a sliding door comprises front and rear latch units attached to front and rear edge portions of the sliding door, respectively, a relay provided within the sliding door for coupling between the latch units and outer and inner open handles of the door, a child-proof mechanism provided on the relay and displaceable between a child-proof condition and a non-child-proof condition, a child-proof lever for displacing the conditions of the child-proof mechanism. The child-proof lever has an operation knob exposed to the outside of the sliding door through an opening formed in a front peripheral plate of the door. The child-proof lever is rotatably mounted to the front latch unit and is connected with the child-proof mechanism through a first rod.

10 Claims, 5 Drawing Sheets

CHILD-PROOF FOR VEHICLE SLIDING DOOR LATCH DEVICE

BACKGROUND OF THE INVENTION

The present invention relates to a latch device for a vehicle sliding door, and in particular to a child-proof device attached to such a latch device.

PRIOR ART OF THE INVENTION

FIG. 1 shows a side surface of a vehicle having a sliding door in which a prior art sliding door latch device is incorporated. The prior art door latch device used for the sliding door C which is slidably engaged with a guide rail B fixed to a side surface of a vehicle body A has a front latch unit D attached to a front edge portion of the sliding door C for engaging with a front striker (not shown) of the vehicle body A, and a rear latch unit D' attached to the rear edge portion of the door C for engaging with a rear striker (not shown) of the vehicle body A. An outer open handle E and an inner open handle F are relatively connected with the latch units D and D' so that an opening operation of the handle E or F can cause the latch units to be released from the strikers.

If the front latch unit D is directly connected to the open handles E and F through more than two rods, and if the rear latch unit D' is directly connected to the handles E and F through more than two rods, a narrow internal space of the sliding door C would be crowded with a plurality of rods. In order to solve this problem, a relay means G has been conventionally provided in the internal space of the door C for coupling between the latch units and the open handles.

The relay means G has a well-known locking mechanism which is connected with a door key cylinder H and an inside lock button K and is displaceable between a locked condition for disabling an opening operation of the handles E and F and an unlocked condition for enabling the opening operation of the handles. The relay means G also has a child-proof mechanism which is displaceable between a child-proof condition for disabling an opening operation of the inner open handle F and a non-child-proof condition for enabling the opening operation of the inner open handle F (referring to Japanese Patent Publication No. 58-25155).

An operation knob L for switching the conditions of the child-proof mechanism has to be located at a position where it cannot be manipulated when the sliding door C is closed but it can be simply manipulated when the sliding door C is opened. Accordingly, an opening portion N through which the operation knob L is exposed to the outside of the door, is formed in the front peripheral plate M of the sliding door C.

The relay means G shown in FIG. 2 is located in the vicinity of the opening portion N so that the operation knob L attached to the relay means G can reach the opening portion N. However, since the open handles E and F, the key cylinder H and the inside lock button K which should be connected with the relay means G are arranged at various positions among doors, it is desirable to appropriately arrange the relay means G, depending upon the positions of these components.

SUMMARY OF THE INVENTION

The present invention is devised in order to optionally locate the relay means at an optimum position, depending upon positions where the open handles, the key cylinder and the lock button.

DESCRIPTION OF THE PREFERRED EMBODIMENTS

Figure 1:
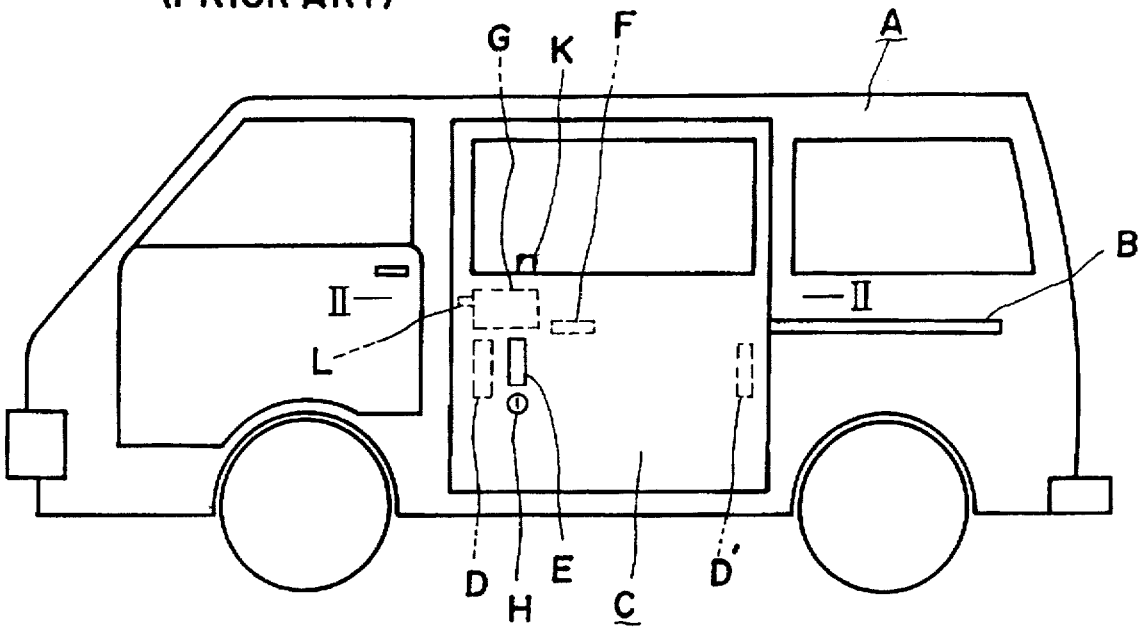
FIG. 1 (PRIOR ART)
FIG. 1 is a side view illustrating a vehicle having a sliding door incorporating a prior art sliding door latch device.
Figure 2:
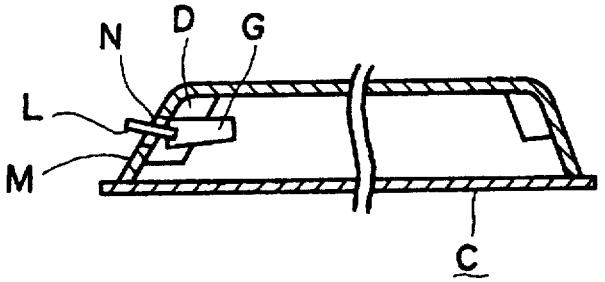
FIG. 2 (PRIOR ART)
FIG. 2 is a sectional view along line II—II in FIG. 1.
Figure 3:
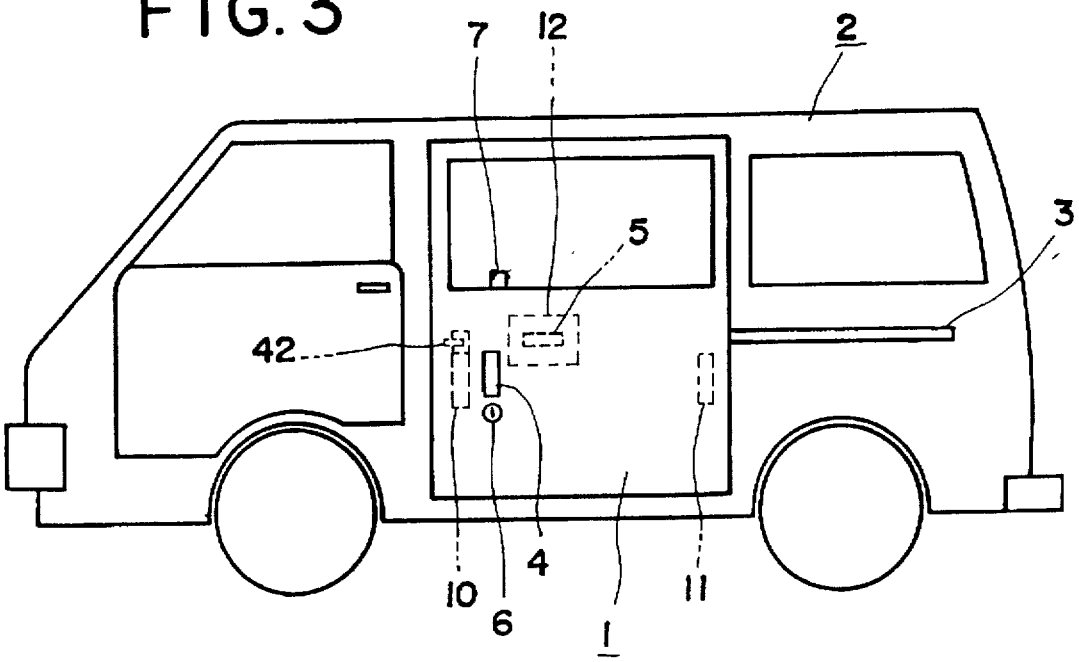
FIG. 3 is a side view illustrating a vehicle having a sliding door incorporating a door latch device according to the present invention.

Explanation will be made of an embodiment of the present invention with reference to the accompanying drawings. A sliding door 1 which is opened and closed by moving in front-and-rear direction along a guide rail 3 of a vehicle body 2 has an outer open handle 4, an inner open handle 5, a door key cylinder 6, and an inside lock button 7. A front latch unit 10 is mounted at the front edge portion of the door 1 for engaging with a front striker 8 (FIG. 4) fixed to the vehicle body 2. A rear latch unit 11 is mounted at the rear edge portion of the door 1 for engaging with a rear striker 9 fixed to the vehicle body 2. When the latch units 10 and 11 are engaged with the strikers 8 and 9, the sliding door is held in a door closed condition.

A relay means 12 for coupling between the open handles 4 and 5 and the latch units 10 and 11 is provided in the sliding door 1. The latch device according to the present invention is composed of the latch units 10 and 11 and the relay means 12.

Figure 7:
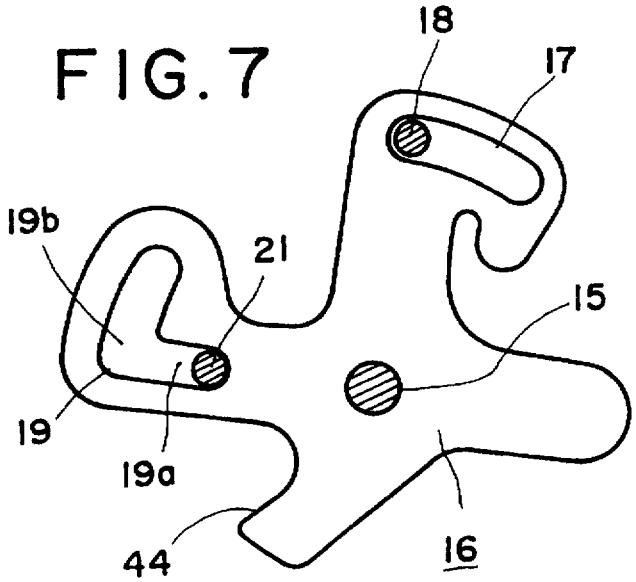
FIG. 7 is a front view illustrating an outer open lever of the present invention.
Figure 5:
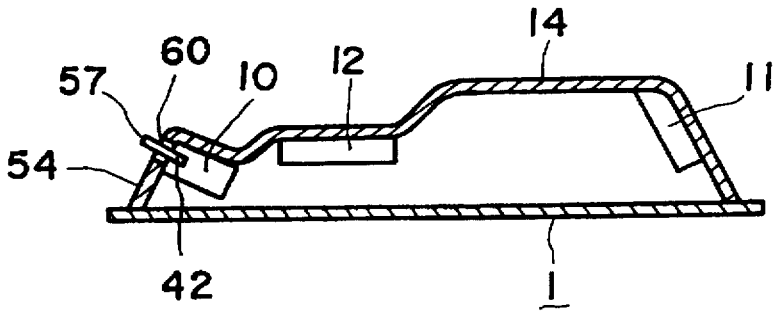
FIG. 5 is a sectional view along line V—V in FIG. 4.
Figure 6:
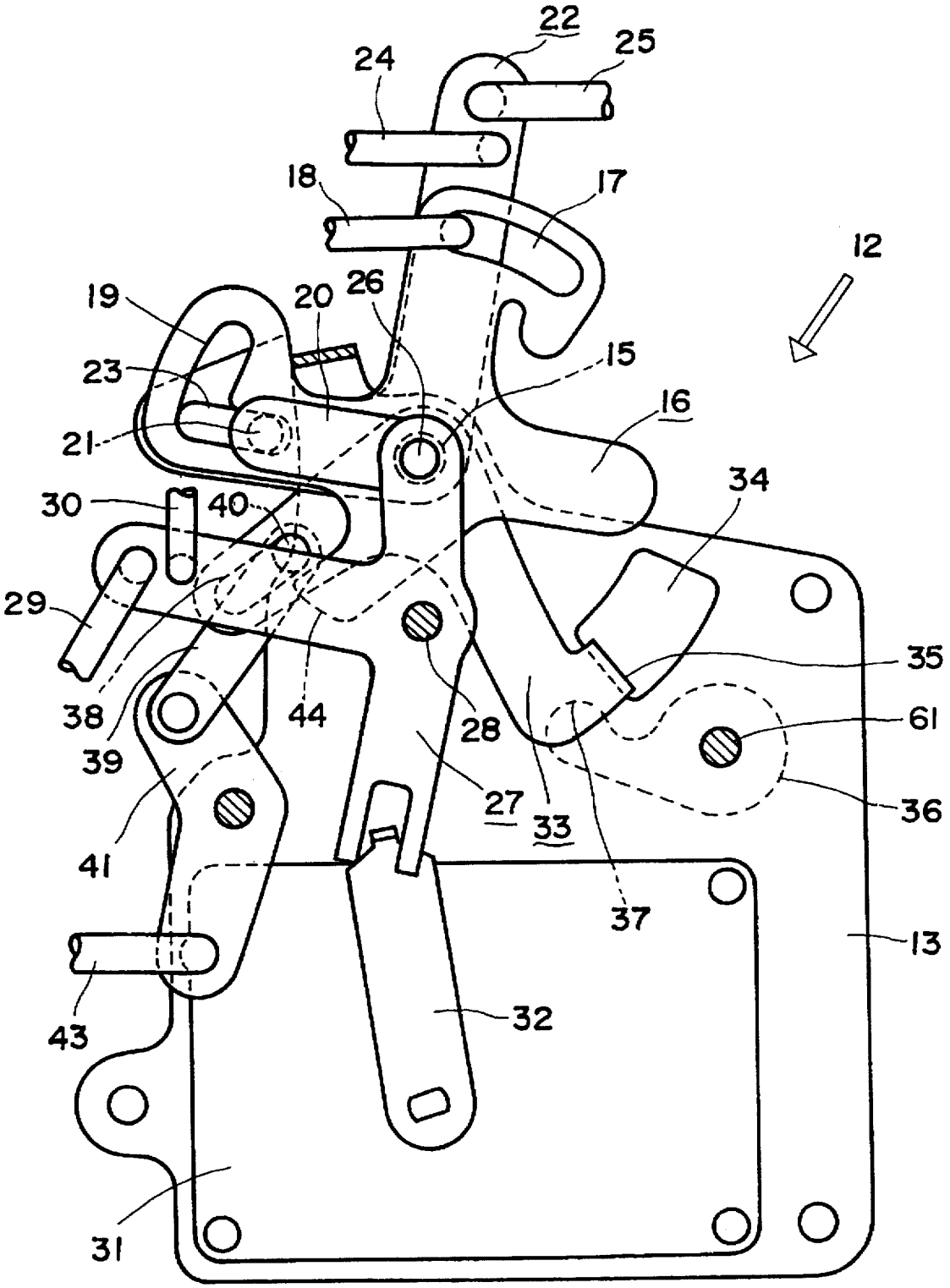
FIG. 6 is a front view illustrating a relay means of the present invention.

The details of the relay means 12 is shown in FIG. 6. The relay means 12 has a base plate 13 which is secured to a metal inner plate 14 (FIG. 5) of the sliding door 1. An outer open lever 16 (FIG. 7) is rotatably journalled to the plate 13 by a shaft 15. The open lever 16 has a arcuate hole 17 centered at the shaft 15, with which a bent portion of a rod 18 extending to the outer open handle 4 is engaged. The open lever 16 also has an L-shaped hole 19 with which a pin 21 fixed to a left end of a lock link 20 is engaged.

Figure 8:
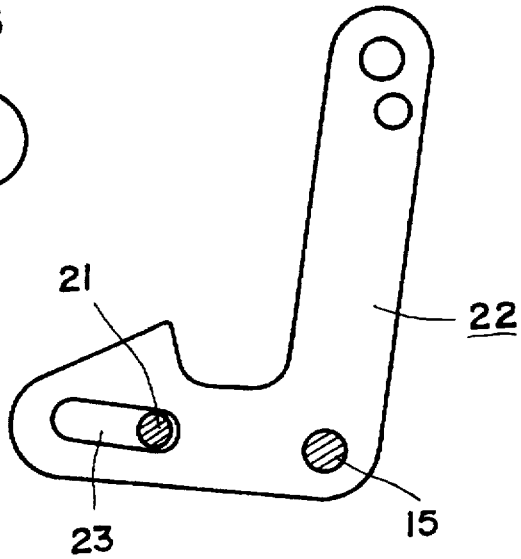
FIG. 8 is a front view illustrating a latch lever of the present invention.

A latch lever 22 is journalled to the shaft 15 so as to overlap with the open lever 16. As shown in FIG. 8, the latch lever 22 has a slot 23 with which the pin 21 is engaged. The slot 23 extends radially of the shaft 15, and is superposed with an engaging part **19*a* of the L-shaped hole 19. The front latch unit 10 is connected with the latch lever 22 through a rod 24, and the rear latch unit 11 is connected with the latch lever 22 through a rod 25. The latch units 10 and 11 release the strikers 8 and 9 when the latch lever 22 is turned counterclockwise in FIG. 6**.

As the pin 21 of the lock link 20 is located in the engaging part **19*a* of the hole 19, the relay means 12 comes into an unlocked condition, and accordingly, a counter-clockwise rotation of the outer open lever 16 is transmitted to the latch lever 22 through the pin 21. However, as the pin 21 is located in a free-play part 19*b* of the L-shaped hole 19**, the relay means 21 comes into a locked condition, and accordingly, the counterclockwise rotation of the outer open lever 16 is not transmitted to the latch lever 22, therefore precluding opening of the door.

A lock lever 27 is rotatably mounted on the base plate 13 by a shaft 28. The right end of the lock link 20 is pivoted to the lock lever 27 by a pin 26. The lock lever 27 and the key cylinder 6 is connected to each other by a rod 29, and the lock lever 27 and the inside lock button 7 is connected to each other by a rod 30. When the lock lever 27 is turned by means of the operation of the key cylinder 6 or the inside lock button 7, the lock link 20 is slidably displaced between the locked position and the unlocked position. It is noted that in the unlocked condition the pin 26 is superposed with the shaft 15 as shown in FIG. 6.

An actuator 31 which is fixed to the base plate 13 has a drive lever 32 engaged with the lock lever 27.

An L-shaped inner open lever 33 is rotatably attached to the base plate 13 by means of the shaft 15. A bent piece 35 which is engaged with the peripheral edge of an opening 34 of the base plate 13 is formed on one end portion of the inner open lever 33.

Figure 4:
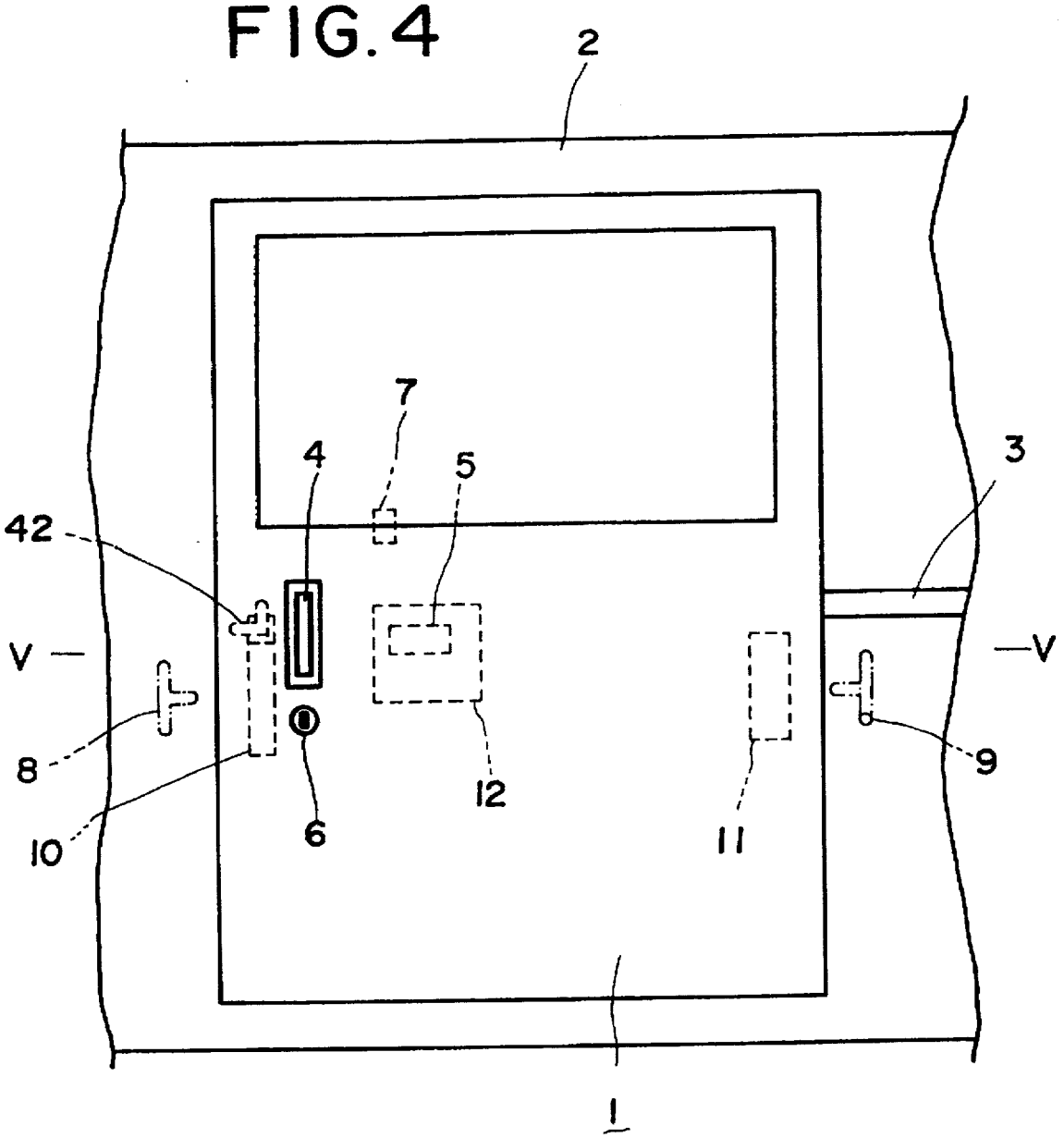
FIG. 4 is an enlarged view illustrating the sliding door shown in FIG. 3.

A rotary member 36 is rotatably attached to a shaft 61 to the reverse side of the base plate 13. As shown in FIG. 4, the relay means 12 is desirably arranged at a position where it is substantially superposed with the inner open handle 5, and the inner open handle 5 is directly coupled to the rotary member 36 with no rod therebetween. Accordingly, the necessity of a one rod can be eliminated. A tip end 37 of the rotary member 36 is opposed to the bent piece 35.

The inner open lever 33 has an elongated hole 38 extending radially of the shaft 15. A pin 40 fixed to one end of a child link 39 is engaged in the elongated hole 38. The other end of the child link 39 is journalled to a crank lever 41 which is coupled with a rod 43 extending to a child-proof lever 42 shown in FIG. 9. The lever 42 is displaced between a non-child-proof position where the pin 40 of the link 39 can be engaged with an engaging arm 44 of the outer open lever 16, and a child-proof position where the pin 40 cannot be engaged with the engaging arm 44.

When the inner open lever 33 is turned counterclock-wise through the intermediary of the rotary member 36 by the opening manipulation of the inner open handle 5 under the non-child-proof condition, the pin 40 engages with the engaging arm 44 to thereby turn the outer open lever 16 counterclockwise. At this time, if the lock lever 27 is in the unlocked position, the counterclockwise rotation of the outer open lever 16 causes the latch units 10 and 11 to release the strikers 8 and 9 and thereby the door is open.

On the contrary, when the child-proof lever 42 is located at the child-proof position, even though the inner open lever 33 is turned counterclockwise by the door opening manipulation of the inner open handle 5, the pin 40 cannot engage with the arm 44 of the outer open lever 16. Therefore, the door cannot be open even though the lock lever 27 is located at the unlocked position.

Figure 9:
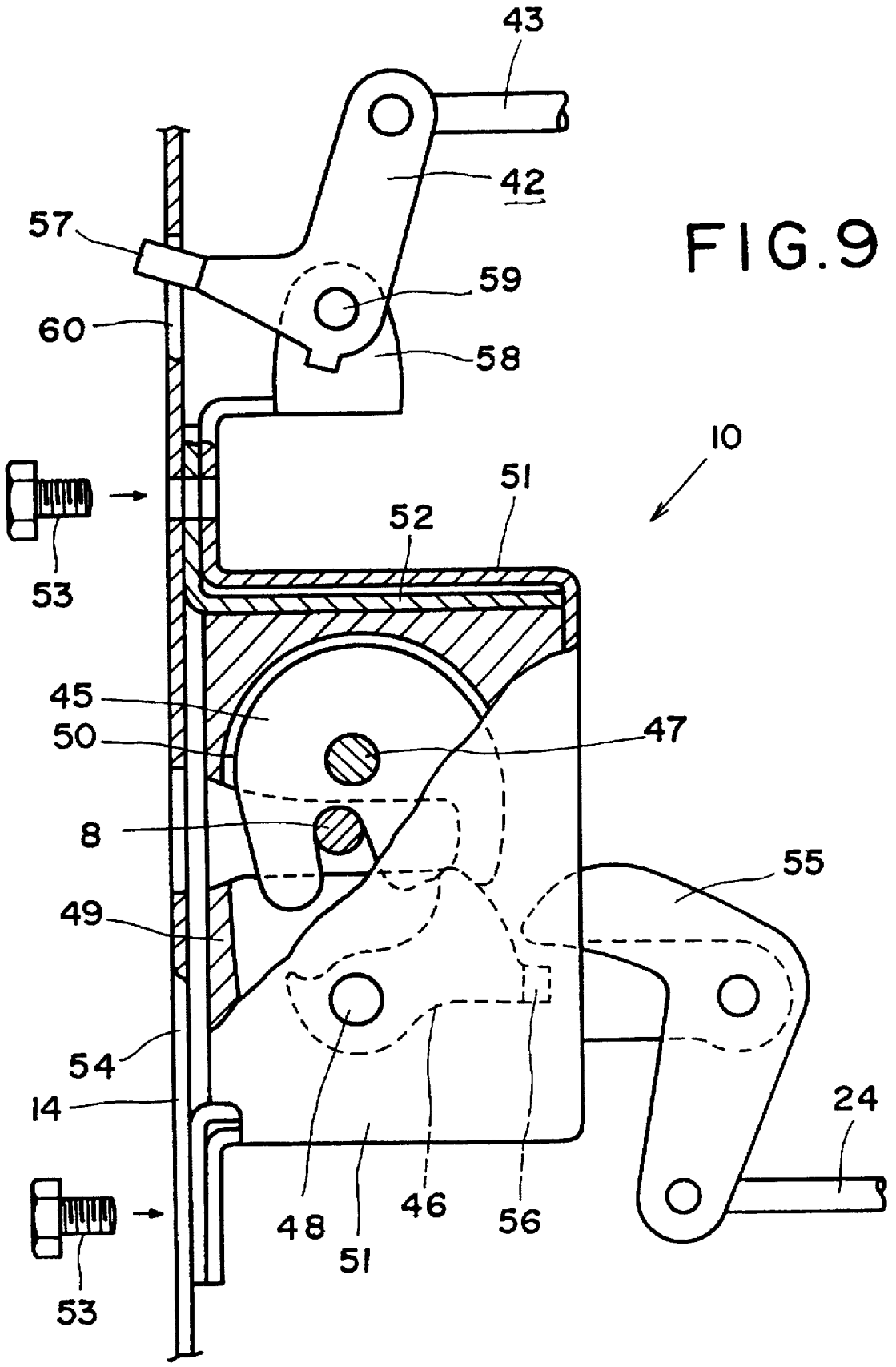
FIG. 9 is a partially sectional view illustrating a front latch unit of the present invention.

FIG. 9 shows the front latch unit 10. The front latch unit 10 is composed of a latch or fork 45 adapted to be engaged with the striker 8, and a ratchet or pawl 46 engaged with the latch 45 so as to prevent the latch 45 from reversely turning. The latch 45 and the ratchet 46 are rotatably received in a resin body 49 by means of shafts 47 and 48, respectively. The resin body 49 is sandwiched between two metal cover brackets 51 and 52 which are attached to a front peripheral plate 54 of the inner plate 14 (FIG. 5) of the door by means of bolts 53 or the like.

The metal bracket 51 is rotatably journalled thereto with a rotary lever 55 which is coupled with the rod 24 extending to the latch lever 22. A tip end of the rotary lever 55 is opposed to a protrusion 56 of the ratchet 46.

The child-proof lever 42 is journalled by means of a pin 59 to a sub-bracket 58 which is integrally formed with the metal bracket 51. An operation knob 57 of the child-proof lever 42 is projected outward of the door through an opening 60 formed in the front peripheral plate 54.

In the arrangement according to the present invention, as mentioned above, the relay means 12 incorporating the child-proof mechanism, is secured to the inner plate 14 of the sliding door 1 by means of bolts and the like, taking into consideration of the positions of the outer and inner open handles 4 and 5, the door key cylinder 6, the inside lock button 7 and the front and rear latch units 10 and 11. Preferably, the relay means 12 is located at the center among the above-mentioned components, or at a position where it superposed with the inner open handle 5. With this arrangement, a plurality of rods for coupling the relay means 12 with the components are prevented from being jumbled, and can be arranged in order with the internal space of the door 1.

Further, since the child-proof lever 42 is rotatably journalled to the front latch unit 10, the attachment of the child-proof lever 42 can be completed only by securing the front latch unit 10 to the front peripheral plate 54. Accordingly, it is possible to eliminate the necessity of a member for attaching the child-proof lever to the sliding door.

What is claimed is:

1. A vehicle sliding door arrangement having an outer open handle provided on an outer surface of a sliding door and an inner open handle provided on an inner surface of the sliding door, and said sliding door being slidably mounted to a vehicle body in a front-and-rear direction of the vehicle body, said arrangement comprising:

a front latch unit attached to a front edge portion of the sliding door and engageable with a front striker fixed to the vehicle body;

a rear latch unit attached to a rear edge portion of the sliding door and engageable with a rear striker fixed to the vehicle body;

a relay means provided within the sliding door for coupling between the outer and inner open handles and the front and rear latch units and for transmitting a door opening manipulation force of the outer and inner open handles to the latch units;

a lock mechanism provided on the relay mechanism and coupled to at least one of a door key cylinder and an inside lock button of the sliding door, said lock mechanism being displaceable between a locking condition in which the door opening manipulation force of the outer and inner open handles cannot be transmitted to the latch units and an unlocked condition in which the door opening manipulation force of the outer and inner open handles can be transmitted to the latch units;.

a child-proof mechanism provided on the relay means and displaceable between a child-proof condition in which the door opening manipulation force of the inner open handle cannot be transmitted to the latch units and a non-child-proof condition in which the door opening manipulation force of the inner open handle can be transmitted to the latch units through the lock mechanism;

a child-proof lever for displacing the child-proof mechanism between the child-proof condition and the non-child-proof condition, at least a part of said child-proof lever being exposed to the outside of the sliding door through an opening formed in a front peripheral plate of the sliding door which is inaccessible from a cabin of the vehicle when the door is closed;

wherein said child-proof lever is rotatably mounted to the front latch unit, and is connected with the child-proof mechanism through a first coupling means.

2. A latch device as set forth in claim 1, wherein said relay means has a base plate to be fixed to an inner plate of the sliding door, and wherein said child-proof mechanism is mounted on the base plate.

3. A latch device as set forth in claim 1, wherein said front latch unit has a bracket for securing the front latch unit to the front edge portion of the sliding door, and wherein said child-proof lever is rotatably mounted to the bracket.

4. A latch device as set forth in claim 1, wherein said relay means and said inner open handle are superposed with each other.

5. A latch device as set forth in claim 1, wherein said relay means and said inner open handle are superposed with each other so that the inner open handle is connected with the relay means without using a coupling means.

6. A latch device as set forth in claim 1, wherein said child-proof mechanism has a child link displaceable between a child-proof position in which the door opening manipulation force of the inner open handle cannot be transmitted to the latch units and a non-child-proof position in which the door opening manipulation force of the inner open handle can be transmitted to the latch units through the lock mechanism.

7. A latch device as set forth in claim 1, wherein said relay means has an outer open lever connected with the outer open handle through a second coupling means, an inner open lever connected with the inner open handle through a third coupling means, and a latch lever connected with the front and rear latch units through fourth and fifth coupling means, respectively.

8. A latch device as set forth in claim 7, wherein said child-proof mechanism has a child link displaceable between a child-proof position in which the door opening manipulation force of the inner open handle cannot be transmitted to the outer open lever and a non-child-proof position in which the door opening manipulation force of the inner open handle can be transmitted to the outer open lever.

9. A latch device as set forth in claim 8, wherein said child-proof mechanism has a crank lever connected with the child-proof lever through the first coupling means, and wherein said child link is slidably engaged with the crank lever.

10. A vehicle sliding door arrangement having an outer open handle provided on an outer surface of a sliding door and an inner open handle provided on an inner surface of the sliding door, and said sliding door being slidably mounted to a vehicle body in a front-and-rear direction of the vehicle body, said arrangement comprising:

a front latch unit attached to a front edge portion of the sliding door and engageable with a front striker fixed to the vehicle body;

a rear latch unit attached to a rear edge portion of the sliding door and engageable with a rear striker fixed to the vehicle body;

a relay means provided within the sliding door for coupling between the outer and inner open handles and the front and rear latch units and for transmitting a door opening manipulation force of the outer and inner open handles to the latch units, said relay means having an outer open lever connected with the outer open handle, an inner open lever connected with the inner open handle, and a latch lever connected with the front and rear latch units;

a lock mechanism provided on the relay mechanism and coupled to at least one of a door key cylinder and an inside lock button of the sliding door, said lock mechanism being displaceable between an unlocked condition in which the lock mechanism interconnects the outer open lever and the latch lever and a locked condition in which the lock mechanism disconnects the outer open lever and the latch lever;

a child-proof mechanism provided on the relay means and displaceable between a non-child-proof condition in which a child-proof mechanism interconnects the inner open lever and the outer open lever and a child-proof condition in which the child-proof mechanism disconnects the inner open lever and the outer open lever;

a child-proof lever for displacing the child-proof mechanism between the child-proof condition and the non-child-proof condition, at least a part of said child-proof lever being exposed to the outside of the sliding door through an opening formed in a front peripheral plate of the sliding door;

wherein said child-proof lever is rotatably mounted to the front latch unit, and is connected with the child-proof mechanism through a first coupling means.

* * * * *